US006090264A

United States Patent [19]

Piron

[11] Patent Number: 6,090,264

[45] Date of Patent: Jul. 18, 2000

[54] TOOL HOLDING DEVICE FOR THE EXTRACTION AND TRANSFER OF ANODES IN THE CENTER OF AN ALUMINUM FACTORY AND EQUIPMENT TO PUT INTO OPERATION SUCH A DEVICE

[76] Inventor: Gérard Piron, 1 Quai de Serbie, 69006 Lyons, France

[21] Appl. No.: 09/249,875

[22] Filed: Feb. 16, 1999

[51] Int. Cl.[7] ..... C25C 3/10

[52] U.S. Cl. ..... 205/389; 204/245

[58] Field of Search ..... 204/245; 205/389

[56] References Cited

U.S. PATENT DOCUMENTS 3,769,195 10/1973 Weterings ..... 204/244
4,053,384 10/1977 Siegmund ..... 204/244
4,855,031 8/1989 Zannini ..... 204/225
5,435,897 7/1995 Zannini ..... 204/245

*Primary Examiner*—Kathryn Gorgos
*Assistant Examiner*—Thomas H Parsons
*Attorney, Agent, or Firm*—Knobbe, Martens, Olson & Bear, LLP

[57] ABSTRACT

A tool holder module intended to be used in lifting gear, characterized in that it is equipped with two independently motorized lifting member: a first member, which consists of a lifting system with cable(s) wrapped over electrically motorized drum(s) and returned at a sheaving system, the first member being intended to displace a load at a relatively high speed and over a relatively large distance; a second member, one of the constituent elements of which is secured to the end of the cable or cables of the first member after return at the sheaving system and is intended, in cooperation with this system, to displace a heavier load vertically at a lower speed and over a limited distance.

17 Claims, 7 Drawing Sheets

TOOL HOLDING DEVICE FOR THE EXTRACTION AND TRANSFER OF ANODES IN THE CENTER OF AN ALUMINUM FACTORY AND EQUIPMENT TO PUT INTO OPERATION SUCH A DEVICE

BACKGROUND OF THE INVENTION

1. Field of the Invention

The present invention relates in general to the changing of spent anodes in aluminium production electrolysis tanks. It relates most specifically to a module which is able to allow the actual extraction of the spent anodes and to the installation employing such modules.

Aluminium is produced on an industrial scale by the now well-known process of dry electrolysis, that is to say a process involving electrolyzing alumina in a bath of molten cryolite according to the reaction: $Al_2O_3$(Alumina)+$2e^-$+$Na_3[AlF_6]$(Cryolite)→2 Al+$3O_2$+3C→$3CO_2$+F This reaction, which is highly exothermic, therefore uses a molten bath containing a mixture of cryolite and alumina, the temperature of which is generally in excess of 800° C. and consumes a vast amount of electricity, which means that the plants operate continuously, so as to limit the energy losses that are inherent in re-start phases.

The various anodes, usually made of carbon, in each of the tanks need to be replaced regularly without stopping the electrolysis reaction to do so.

Because of the process employed, namely dry electrolysis, a hard crust of fluorinated cryolite alumina forms at the upper surface of the bath, this crust having the advantage of retaining heat within the bath and thus of creating an insulating envelope.

However, extracting the spent anodes from the bath first of all requires this crust to be broken, and experience has shown that the force needed to pull a spent anode out of the said crust is seven to eight times greater than the mass of a fresh anode.

Furthermore, this force lasts for only a few centimeters of the distance, whereas the distance travelled for lifting the anode in each cycle is of the order of three to four meters, typically 3.50 m.

2. Description of the Related Art

To date, in existing plants, these operations have been performed using systems of hydraulic jacks which, to date, have only a limited size to allow them to fit into the volume available above the tanks.

However, regardless of the quality of the oil used in these hydraulic jacks, there is always a risk of fire given the high temperature of the molten bath, and there is a desire to escape from this prohibitive drawback.

Solutions hitherto proposed for avoiding the use of the hydraulic extraction system have run into a problem of size and of the civil engineering works of existing plants. Specifically, these solutions typically employ a cable system which takes up a greater amount of space which is incompatible with these plants or, requiring the production of new plants, have too significant an effect on the corresponding costs before they can be amortized.

BRIEF SUMMARY OF THE INVENTION

The object of the invention is therefore to propose an installation for changing spent anodes in a series of electrolysis tanks which avoids these drawbacks and in particular, is compatible with the existing works and can avoid the risks inherent in the use of hydraulic devices. It relates firstly to a tool holder module, in particular, intended to take a tool to allow the spent anodes to be pulled out and transferred. This tool holder can also incorporate any type of tool and in particular a device capable of breaking the upper crust formed at the surface of the bath, but also a shovel or the like, intended to collect the pieces of crust that result from this breakage.

The tool holder module intended to be used in a lifting installation is characterized in that it is equipped with two independently motorized lifting members:

- a first member, which consists of a set of cable(s) and electrically motorized drum(s) returned at a sheaving system, intended to displace a load at relatively high speed and over a relatively large distance;
- a second member, one of the constituent elements of which is secured to the end of the cable or cables of the said first member after return at the sheaving system and is intended, in cooperation with this system, to displace a heavier load vertically at a lower speed and over a limited distance.

The invention therefore consists, initially, in differentiating between two movements, namely a movement requiring an intense force over a short distance at a low speed, and a movement requiring a much lower force over a much longer distance, at a speed which is also far higher.

Principally, this module is most specifically suited to pulling out and transferring spent anodes. In fact, the second member is intended to allow the use of an intense pulling force needed and sufficient to allow the actual pulling of the spent anode out of the electrolysis bath whereas the first member, once said anode has actually been pulled out, displaces this anode outside of the tank.

According to one advantageous feature of the invention, the first member consists of a lifting system using cable(s), bearing one or more cables wrapped over one or more drums moved by an electric motor, and which are equipped with a sheaving system in the region of which a tool, for example for grasping the anode, for breaking the upper crust of the electrolysis bath, or alternatively a tool which acts as a shovel for collecting the pieces which come from the said layer is attached.

In parallel, the said second member consists of a mechanical or electro-mechanical jack, to the end of which the cable or cables of the said first member is/are attached.

In other words, the invention consists in producing a system for lifting a load, which system is equipped with a fixed point, it being possible for the said fixed point to be made to move over a limited distance through the use of the said second member, that is to say, in this particular instance, a mechanical or electro-mechanical jack.

Advantageously, the module has slack in the cable, so as to limit the load applied by the tool with which the said module is equipped, on an obstacle, and especially the bottom of the electrolysis tank. Furthermore, this slack in the cable makes it possible to keep the turns of cable perfectly wrapped around the drum or drums, and is also designed not to apply forces to the set-down plane, as specified in greater detail later.

According to another feature of the invention, the tool holder module comprises a semi-rigid vertical guide post secured to the chassis of the said module, and along which an actual tool holder carriage slides. Since this is the case, the amplitude of the lateral travel of the sheaving system is limited, particularly near the maximum potential travel allowed by the length of the cables.

The invention also relates to the installation for changing spent anodes in electrolysis tanks for producing aluminium.

This installation comprises a travelling crane which can move over the said tanks and on which there moves, in a direction perpendicular to the translational movement of the crane, a carriage equipped with a tool holder module intended to extract and transfer the spent anodes out of the tanks and to bring fresh anodes up to the said tanks.

This installation is characterized in that the carriage has a vertical shaft which takes a number of coaxial annuli which can be rotated independently of each other, each of the said annuli taking one or more tool holder modules respectively intended:

- to allow the surface crust created at the top surface of the electrolysis bath of each of the tanks to be broken;
- to collect all or some of the pieces that result from breaking the said crust;
- and to extract and transfer the spent anodes from the tanks and bring fresh anodes to the said tanks the said tool holder modules, and therefore the tools which they carry, being capable of describing portions of arcs of circles.

According to the invention, the maximum value of the angle between two end tool holders is ideally smaller than the space occupied by the control cab that is placed above the said vertical shaft. When there is no such cab, the angle separating two end tools or two end tool holders is less than 180°.

Thus, this installation can be employed in existing plants, limiting as far as possible the interference and risks of interaction particularly with the pipes that discharge the gases, especially gases containing fluorine and carbon monoxide and dioxide, given off from each of the tanks.

The way in which the invention may be embodied and the advantages which stem from it will emerge better from the exemplary embodiment which follows, given by way of non-limiting indication with support from the appended figures.

BRIEF DESCRIPTION OF THE DRAWINGS

FIG. 4 is a diagrammatic depiction relating to the principle of operation of the tool holder modules in accordance with the invention, of which;

DETAILED DESCRIPTION OF THE INVENTION

Figure 1:
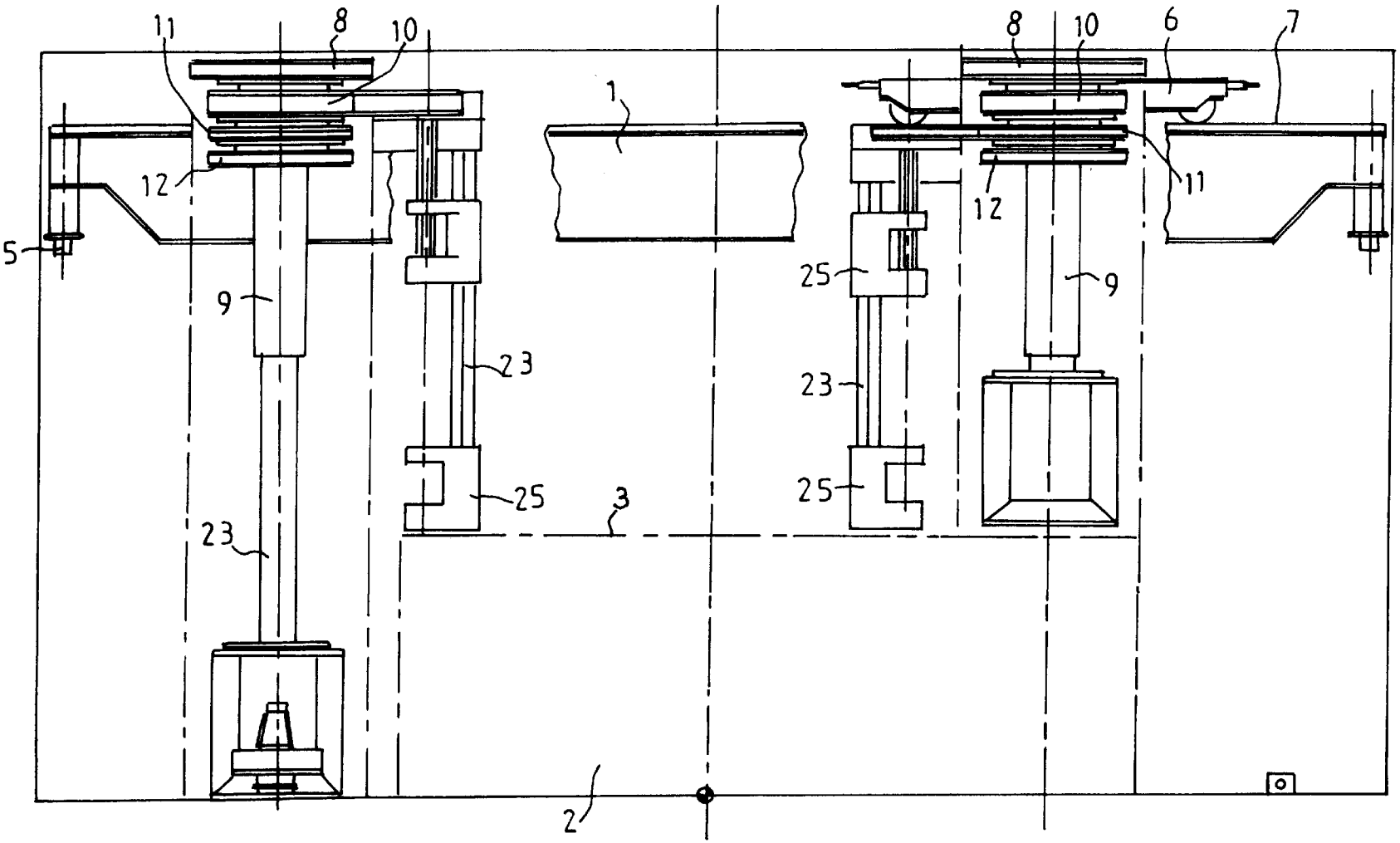
FIG. 1 is a diagrammatic depiction in part section of an installation in accordance with the invention.
Figure 2:
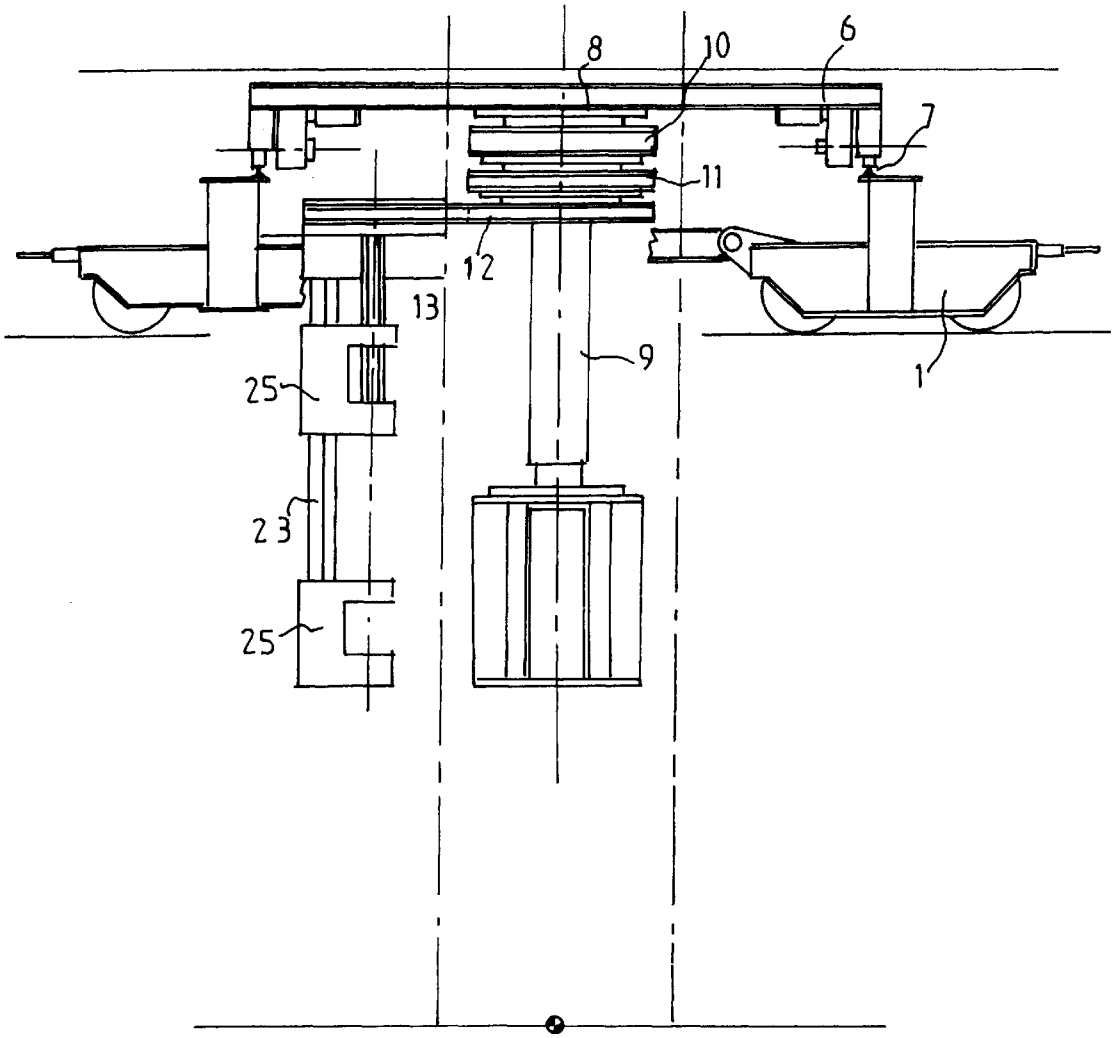
FIG. 2 is a depiction similar to FIG. 1 but seen from a direction perpendicular to the direction of view of FIG. 1.

FIG. 1 depicts a view in part section of the installation in accordance with the invention. Fundamentally, this installation consists of a travelling crane (1) which can move in translation on a runway (5) over an electrolysis tank (2), and more exactly a series of tanks which are essentially identical to one another and in which a molten electrolysis bath containing, in the known way, cryolite and alumina is kept.

Typically, the temperature of the bath is in excess of 800° C., the said bath being subjected to a voltage of about 4.5 volts, the strength of the DC current flowing within this bath typically being of the order of 180,000 to 200,000 amps.

According to the invention, this travelling crane (1) takes a carriage (6) capable of travelling along a runway (7) at right angles to the translational movement of the travelling crane. This carriage (6) takes a platform (8) surmounting a vertical central shaft (9) where a succession of mutually coaxial annuli (10), (11) and (12) respectively is mounted.

These various annuli (10), (11) and (12) can be made to rotate independently of one another by any appropriate means, and in particular by coupling an electric motor to appropriate gearing (not depicted).

Each of these annuli has an extension, lying essentially in the same plane, and at which one or more modules (13, 14, 15) of the type described below is/are attached.

More specifically, each annulus is associated with a specific tool holder module, respectively:

- a tool for bringing fresh anodes and for pulling out and removing the spent anodes;
- a tool for breaking the upper crust of the electrolysis baths;
- a tool, typically a shovel, for collecting all or some of the pieces resulting from breaking the crust.

Figure 3A:
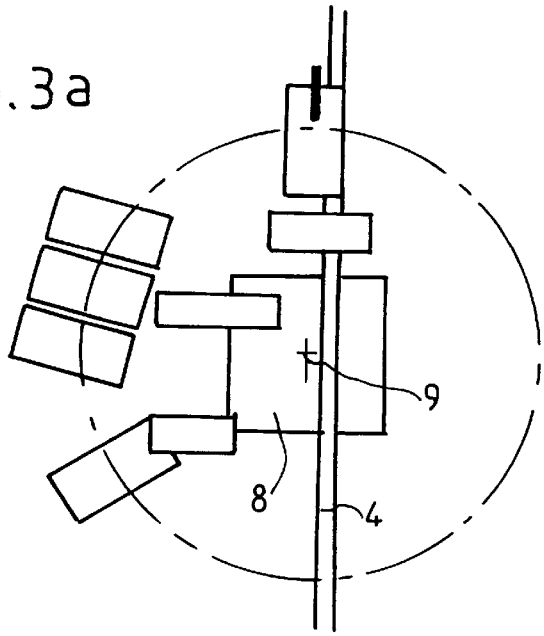
FIGS. 3*a*, 3*b* and 3*c* are diagrammatic plan depictions of the various phases in the displacement of the tool holder modules, particularly at a change of activation of the tool.
Figure 3B:
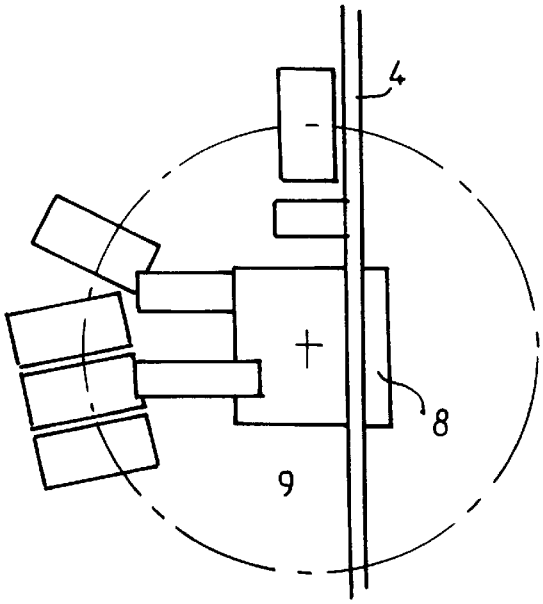
Figure 3C:
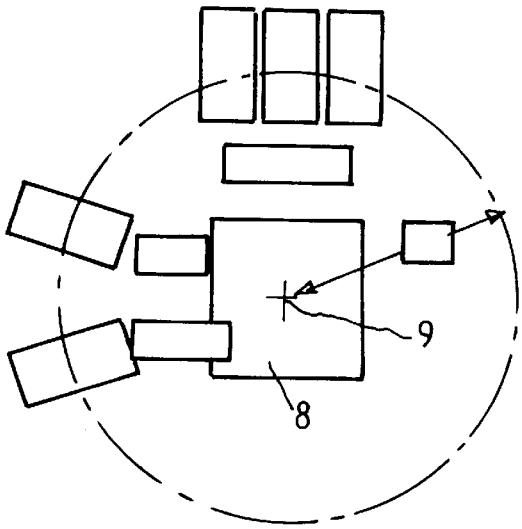
Figure 4:
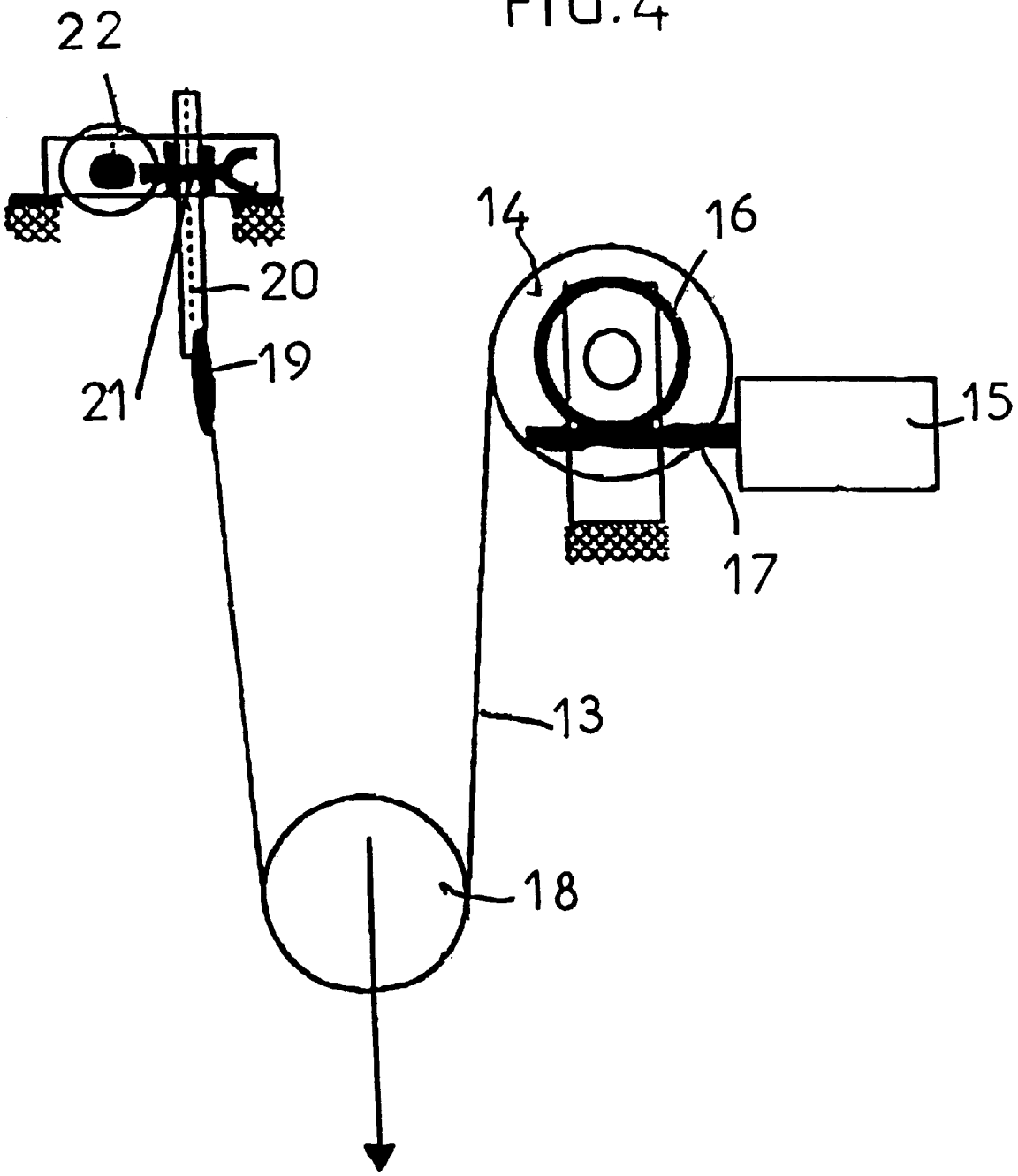

As can be clearly seen in FIGS. 3*a*, 3*b* and 3*c*, for a three-tool configuration, the maximum angle between the two end tools is less than 120°. Thus, the displacement of the carriage (6) is always compatible with, in particular, the pipes (4) for removing fluorine- and carbon-containing gases which are installed in existing plants. In particular, these angles may be defined as a function of the characteristics of the existing plants, without giving rise to any modification whatsoever thereto.

Each of these annuli is equipped with a means of controlling the angle through which the tool or tool holder it carries is rotated, the angle being determined from a fixed point on the shaft that supports the said annuli.

Typically, when the installation is equipped with a programmable controller intended to automate its operation, an encoder (not depicted) mounted on the drive shaft of the geared motor unit that drives the annulus in question indicates the angle through which the tool holder has been rotated from a signal given by an end-off-travel device which does not rotate.

When the installation does not have such a programmable controller, an anti-collision system, of the proximity detector type, mounted on each tool, is associated with the end-of-travel signal which does not rotate, providing relative angular control of the tools.

Advantageously, the platform (8) takes a upper cab (not depicted), intended to house the user, the latter being able therein to actuate the tools in question and the corresponding tool holders while at the same time monitoring the manoeuvre.

Furthermore, the shaft (9) can also take a certain number of additional coaxial annuli, capable of carrying tools other than those mentioned earlier, and in particular a tool for opening the covers (3) of the tanks (2) for example, brushes, etc.

It will be understood that as soon as one of the tools is to be activated, the two other tools are moved away by folding the intermediate tool, that is to say the tool that is positioned between the tool in use and the outermost tool, onto the said outermost tool, so as to allow the desired tool in use to operate freely.

Thus, in FIG. 3*a*, the first operation, once the covers have been opened, is to operate the tool for breaking the upper crust of the electrolyte bath, also known as a poker, the other two tools being folded to the left.

Once the operation of breaking the crust has been performed, the poker is folded to the left towards the pulling-out tool, and the tool carrying the shovel is rotated through 270° until it reaches the point on the tank in question (FIG. 3*b*).

To achieve this and avoid any interaction between the tool or tool holder and the pipework (4), the carriage (6) is first moved along the travelling crane in order to separate the shaft (9), and hence the tool holder modules, from the pipework (4), then the tool in question is rotated, taking care beforehand to raise the tool-holder carriage (25) as far as it will go along the vertical guide post (23), described in greater detail later. When the rotation of the said tool is complete, the carriage (6) is returned to its original position.

Finally, FIG. 3*c*, once the pieces of crust have been collected, the shovel is folded against the poker and the pulling-out tool, which for example comprises three actually identical tools, is in turn rotated through 270° once the carriage (6) has been moved beforehand to allow for the travel of the said tools.

The great simplicity in using the installation in accordance with the invention can thus be understood.

The tool holder modules employed in this installation will now be described in greater detail in connection with FIGS. 4 to 11.

According to a fundamental feature of the invention, each of the tool holder modules, and in particular the anode change modules, comprises two independent activation systems. They first of all comprise a system of cables (13) wrapped onto one or two drums (14), the latter being rotated by means of an electric motor (15) via a worm (17) and wheel (16) reduction gear set, each wheel (16) being secured to and coaxial with one of the drums (14) and cooperating with the worm (17) which is collinear with the drive shaft of the motor (15). These drums are positioned in the region of the upper chassis of each of the modules.

The cable or cables (13) is/are wrapped over two pulleys which constitute a sheaving system (18) and ascend towards a fixed point (19).

The load, and in particular the tool holder in question, is attached in the region of the sheaving system by any appropriate means, itself secured to a carriage (25) as described in greater detail later.

According to the invention, the fixed point (19) is itself secured to the end of the screw (20) of a mechanical jack (21), moved by an electric motor (22).

Thus, this double lifting system makes it possible to employ conventional lifting to shift the anodes over relatively long distances at a relatively high speed for a reduced load, and lifting with pulling out, capable of developing a strong force over a reduced distance at a limited speed.

Through its hauling capability, this device on the one hand is able to develop the force needed to pull out the spent anode which is to be replaced, but on the other hand, given the low corresponding speed, can make installing the fresh anode in the tank easier.

The members in the drive line, and in particular the wheels (16), the drums (14) and the cables (13) are dimensioned as a function of the intense force exerted by the said second member, and to which they are subjected, given the stresses applied to them during the pulling-out phase.

Furthermore, choosing a worm and wheel (17, 16) reduction gear set for the high-speed motor that rotates the drums (14) makes it possible, by using the low indirect efficiency between the reduction gear set and the drum, to reduce the size of the brakes on the drive shaft of the said motor (15) which are needed in the pulling-out phase, and therefore more generally makes it possible to reduce the overall size.

Figure 5:
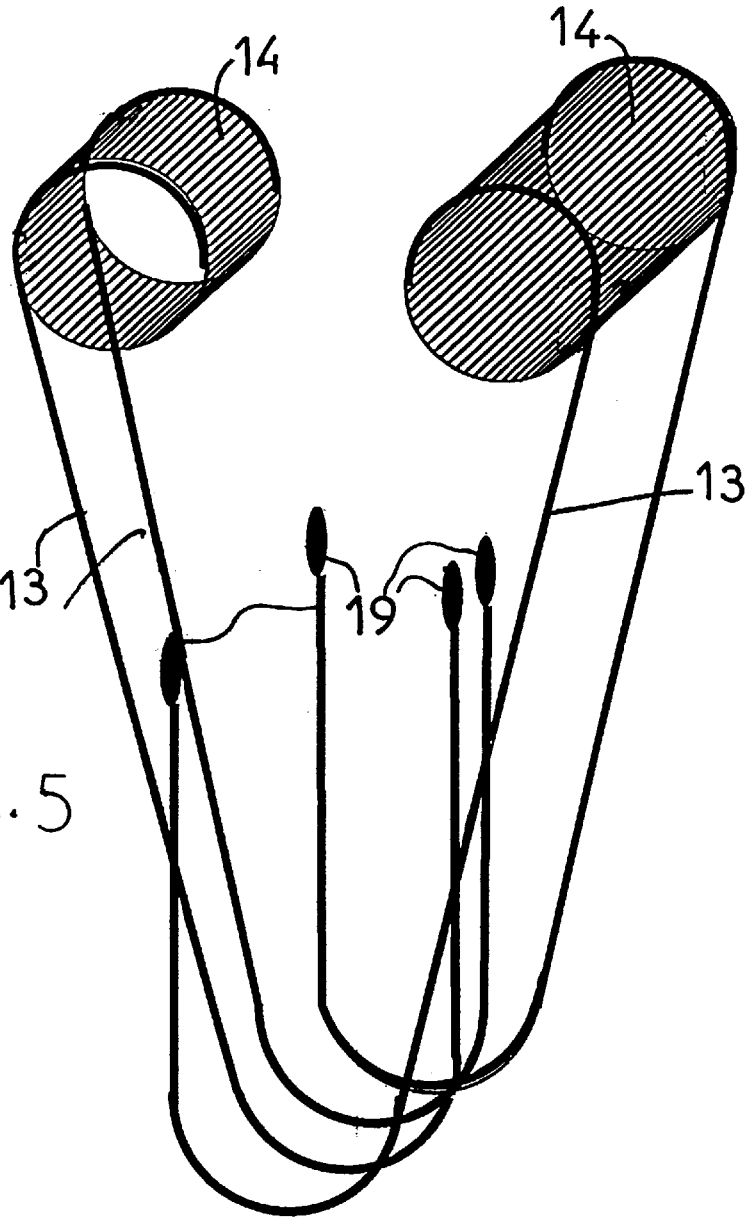
FIG. 5 is a depiction of an example of a cabling system.
Figure 6:
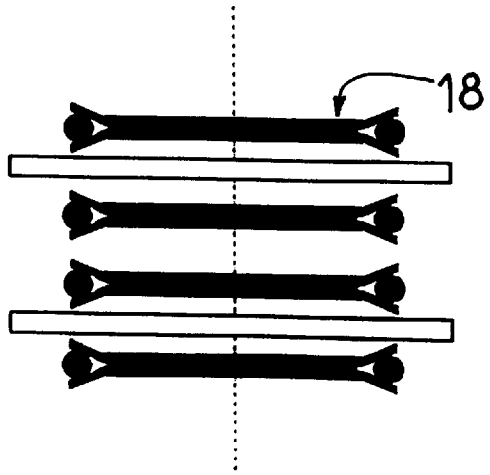
FIG. 6 a view on FIG. 5 from above.

Advantageously, each of the tool holder modules is equipped with two drums (14) which are synchronized through the design of the reduction gear set, each taking two cables (13), so that the total number of cables is four, as depicted in particular in FIGS. 5, for example. In this way, it is possible to reduce the size of the pulleys, the drums and the reduction gear sets and, more generally, reduce the overall size of the device.

Figure 9:
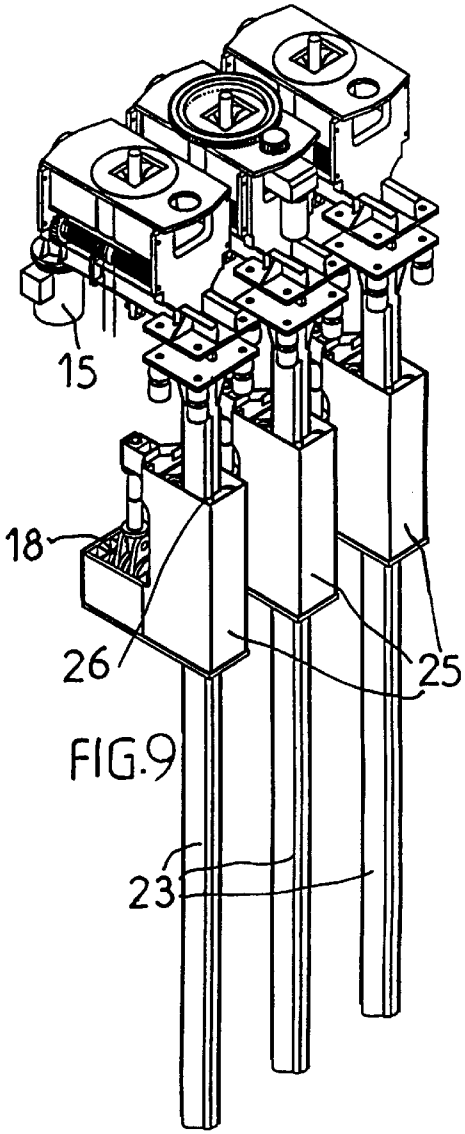
FIGS. 7, 8 and 9 are respectively diagrammatic depictions in perspective of the tool holder module in accordance with the invention, respectively alone and associated with two modules of the same type, in two different views.
Figure 8:
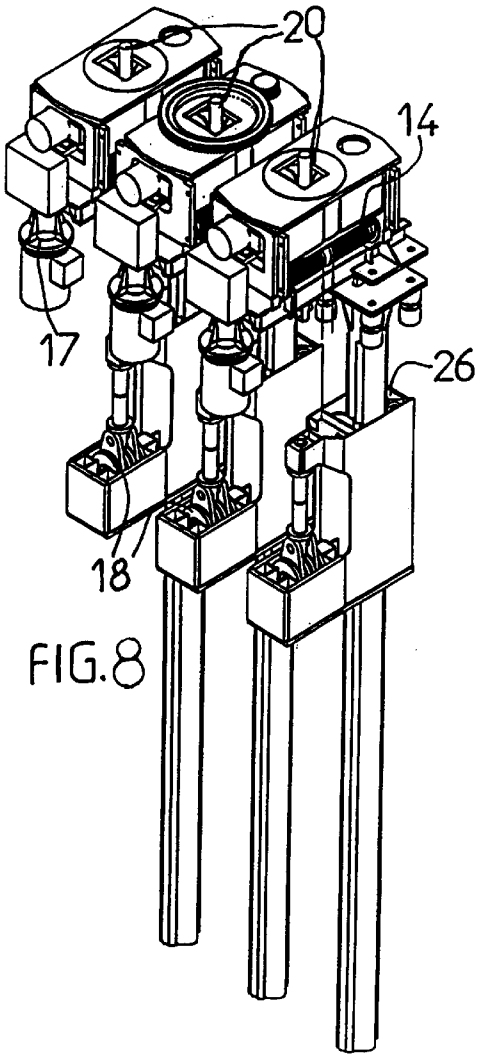

According to one advantageous feature of the invention, the tool holder modules changing the anodes are combined in threes, as depicted in FIGS. 8 and 9. This configuration is intended to allow three spent anodes to be changed simultaneously. Nonetheless, it is clearly understood that each of the modules can operate independently of each other, so that, not withstanding the use of a three-module system, just one or even just two of them may be activated for changing anodes.

The spacing between the three tool holder modules corresponds to the distance between centres of the anodes. This spacing may differ depending on the plant concerned, and is therefore adjustable. It is determined by link rods, the length of which corresponds to the said distance between centres. This measure allows the system to be adapted to suit any type of plant.

Figure 7:
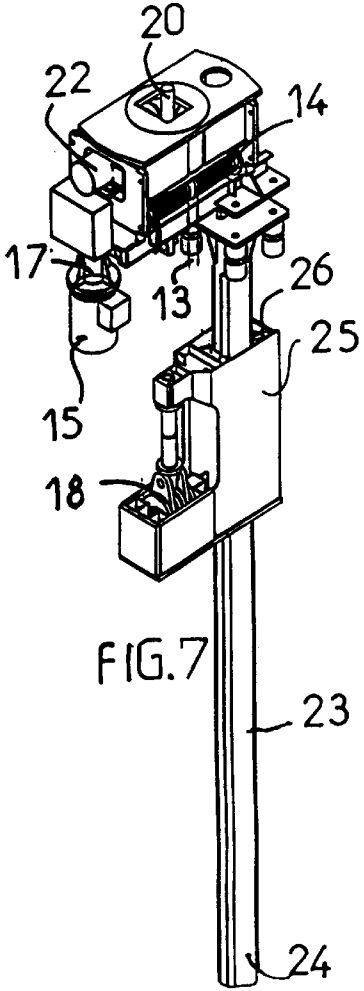

As may be seen in FIGS. 7 to 9, each tool holder module is associated with a vertical guide post (23), secured in the region of the upper chassis to the module via a preloaded device incorporating ball joints thus able to allow the lower part (24) of the post a certain degree of freedom. This post (23) is intended to provide guidance, particularly for a carriage (25) containing the sheaving system (18) and by extending the region from which the load is suspended, this carriage (25) being fitted with rollers (26) resting on each side of the said post (23). This post is semirigid. The threshold for adjusting the preload is such that the risks of angular travel of the said tool holder, particularly at the end of its travel, in the case of limited forces, and especially those inherent to the strong magnetic field which prevails in the plant, and to which the metallic elements that make up most of the elements involved in the construction of the module are subjected, are avoided.

According to another feature of the invention, each module has a system of slack in the cables, thus making it possible to limit the vertical travel of the tool when it encounters an obstacle, such as, for example, when the shovel touches the bottom of the tank. In this last instance, there is a desire to limit such a risk as far as possible, given the relative fragility of the tank. Furthermore, the slack in the cable allows the turns of cable on the drums (14) to be kept in perfect order.

Figure 11:
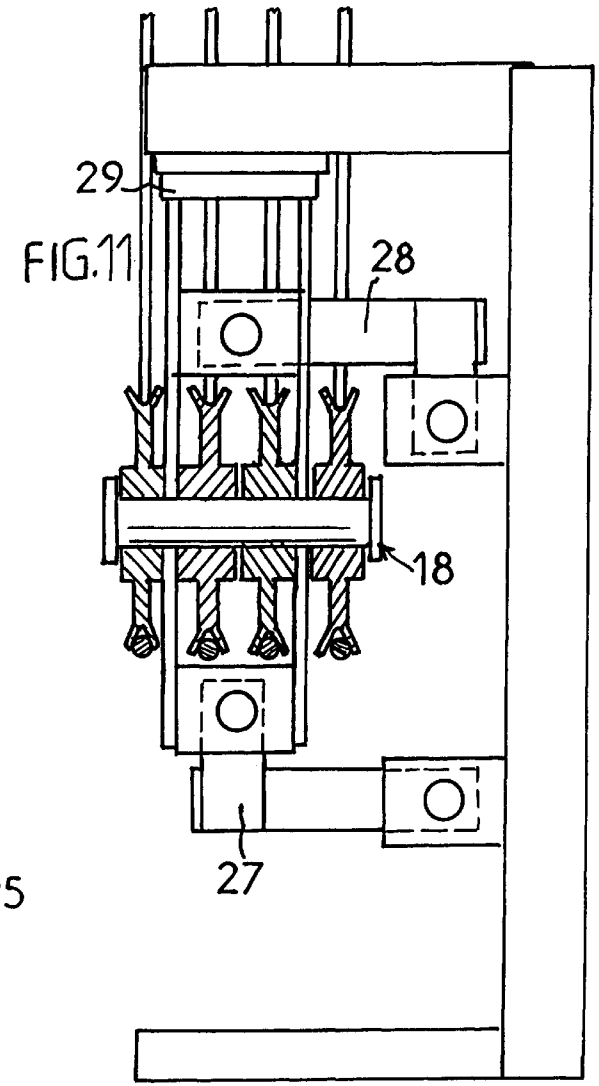
FIGS. 10 and 11 are diagrammatic depictions of the way in which the slack in the cable used at the said module in accordance with the invention operates.
Figure 10:
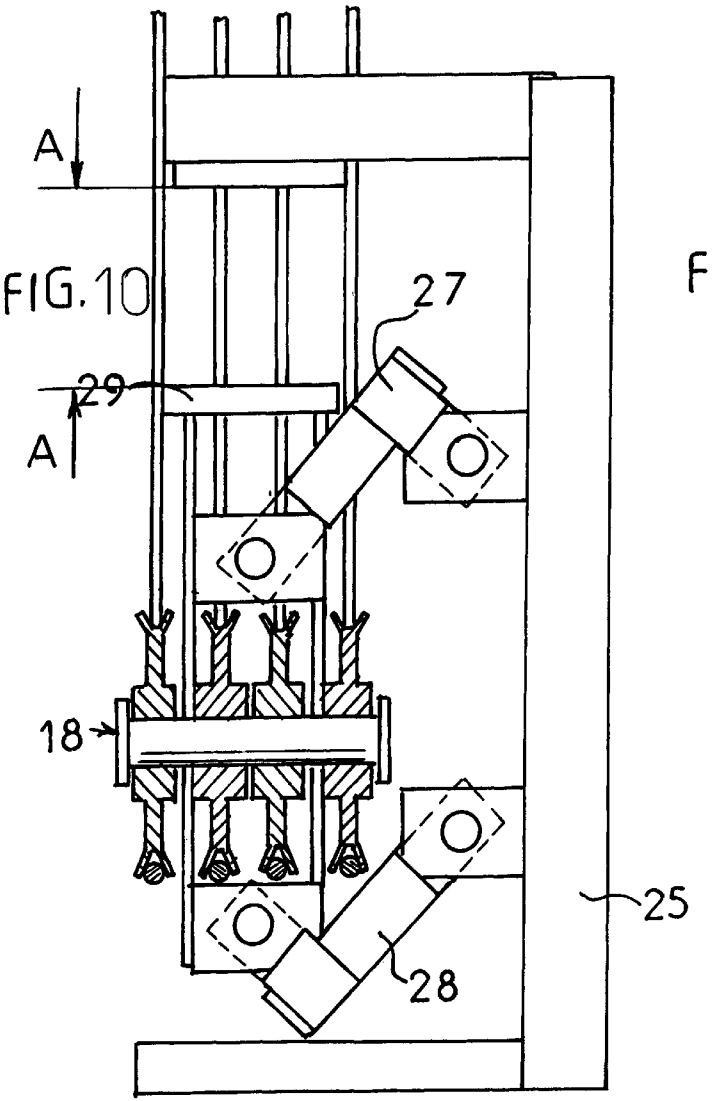

This slack in the cable is described more particularly in connection with FIGS. 10 and 11. It is obtained by securing, in a non-fixed way, the sheaving system (18) to the carriage (25) that moves the tool holder along the post (23) by means of a set of two link rods (27, 28) which can move as a deformable parallelogram and are articulated respectively to the frame (29) in the region of which the sheaving system is mounted and to the said carriage (25), the movement being between two extreme positions corresponding to the travel needed to take up the slack in the cable, which travel is depicted by the double arrow A in FIG. 10.

Thus, FIG. 10 depicts the carriage (25) resting on a nearby object or obstacle, the frame (29) no longer being in contact with the said carriage (25). A sensor (not depicted) positioned between the carriage (25) and the frame (29) will have given the command to stop the lifting motor while a downwards movement was in progress. The maximum stopping distance of the mobile sheaving system is depicted by the double arrow A.

FIG. 11 depicts the carriage (25) suspended without contact with the surroundings, the frame (29) which carries the sheaving pulleys being in contact with the carriage (25).

Advantageously, a spring may be fitted between the upper face of the frame (29) and the carriage (25) so as to reduce the apparent weight of the said carriage on a nearby object, this scenario safeguarding the electrolysis tank and its surroundings.

The tool holder module in accordance with the invention is dimensioned to tolerate forces on the charge of close to 10 tonnes for speeds of the order of one millimeter per second. By contrast, for speeds of the order of 15 meters per minute and far longer distances, the force during movement is of the order of 2 tonnes.

The use of such modules, activated electrically, has proved to be entirely adequate for existing plants that produce aluminium by electrolysis insofar that in particular, because of the physical separation between the functions associated with different loads, it allows the reactions of the rollers on the runways of the existing buildings to be limited and therefore requires no extension of the civil engineering works while at the same time allowing the safety conditions to be improved significantly.

What is claimed is:

1. An apparatus for changing spent anodes in an electrolysis tank for producing aluminum by dry electrolysis comprising:

a travelling crane, wherein said crane moves in a first direction over the electrolysis tank;

at least one carriage attached to said travelling crane, wherein said at least one carriage moves in a second direction perpendicular to the first direction;

a vertical shaft attached to said at least one carriage;

a plurality of coaxial annuli placed around said shaft, wherein said annuli can be rotated independently of one another; and one or more tool holder modules attached to said annuli.

2. The apparatus of claim 1, wherein said one or more tool holder modules comprises:

a first lifting member comprising:

at least one drum; and an electrical motor coupled to said at least one drum;

a second lifting member comprising a mechanical or electro-mechanical jack;

a sheaving system comprising two pulleys; and one or more cables, said cables having at least one end, wherein said one or more cables are wrapped over said at least one drum, around said pulleys, and are fixed to said jack by said at least one end.

3. The apparatus of claim 2, further comprising a tool for bringing fresh anodes and for pulling out and removing spent anodes, wherein said tool for bringing fresh anodes and for pulling out and removing spent anodes is attached to the sheaving system on one of said one or more tool holder modules.

4. The apparatus of claim 2, further comprising a tool for breaking an upper crust an a electrolysis tank into pieces of crust, wherein said tool for breaking an upper crust in an electrolysis tank is attached to the sheaving system on one of said one or more tool holder modules.

5. The apparatus of claim 4, further comprising a tool for collecting all or some of said pieces of crust, wherein said tool for collecting pieces of crust is attached to said sheaving system on one of said one or more tool holder modules.

6. The apparatus of claim 2, further comprising a platform and cab mounted on top of said at least one carriage.

7. The apparatus of claim 2, further comprising a tool attached to said sheaving system, wherein said first lifting member lifts said tool at higher speed and with less force than said said second lifting member.

8. The apparatus of claim 2, wherein said electrical motor is coupled to said at least one drum via a worm and wheel reduction gear set.

9. The apparatus of claim 8, wherein the wheel of said worm and wheel gear set is secured to and coaxial with said at least one drum.

10. The apparatus of claim 8, wherein the worm of the worm and wheel reduction grear set is collinear with the motor drive shaft.

11. The apparatus of claim 2, wherein there is slack in said one or more cables.

12. The apparatus of claim 2, further comprising a semi-rigid vertical guide post, wherein said guide post is secured to said tool module.

13. The apparatus of claim 12, further comprising a preloading device, wherein said preloading device secures said guide post to said tool module, and wherein said preloading device allows the lower part of said guide post freedom of movement.

14. A method for removing spent anodes in an electrolysis bath for producing aluminum comprising:

providing an apparatus comprising:

a first lifting member comprising:

at least one drum; and an electrical motor coupled to said at least one drum;

a second lifting member comprising a mechanical or electro-mechanical jack;

a sheaving system comprising two pulleys;

one or more cables, said cables having at least one end, wherein said one or more cables are wrapped over said one or more drums, around said pulleys, and are fixed to said jack by said at least one end; and a tool for attaching to said anodes, wherein said tool for attaching to said anodes is attached to said sheaving system;

activating said jack to move said anode a short distance; and activating said motor to rotate said at least one drum, thereby removing said anode, wherein activating said jack takes place before activating said motor.

15. The method of claim 14, wherein activating said jack moves said anode at lower speed and with more force than activating said motor.

16. The method of claim 14, further comprising breaking a crust on said electrolysis bath into pieces, wherein said breaking precedes removing said anode.

17. The method of claim 16, further comprising collecting said pieces, wherein said collecting follows said breaking.

* * * * *

UNITED STATES PATENT AND TRADEMARK OFFICE

CERTIFICATE OF CORRECTION

PATENT NO. : 6,090,264
DATED : July 18, 2000
INVENTOR(S) : Gerard Piron

It is certified that error appears in the above-identified patent and that said Letters Patent is hereby corrected as shown below:

Claim 7, page 8,
Line 16, please delete -- said said -- and replace with -- said --

Signed and Sealed this

Eighteenth Day of December, 2001

*Attest:*

*Attesting Officer*

JAMES E. ROGAN
*Director of the United States Patent and Trademark Office*